United States Patent [19]

Jaroska et al.

[11] 4,089,268

[45] May 16, 1978

[54] SAFE ARMING SYSTEM FOR TWO-EXPLOSIVE MUNITIONS

[75] Inventors: Miles F. Jaroska; William A. Niven; Jasper J. Morrison, all of Livermore, Calif.

[73] Assignee: The United States of America as represented by the United States Department of Energy, Washington, D.C.

[21] Appl. No.: 782,871

[22] Filed: Mar. 30, 1977

[51] Int. Cl.[2] ..... F42C 15/40
[52] U.S. Cl. ..... 102/70.2 R
[58] Field of Search ..... 102/70.2 R, 70.2 G

[56] References Cited

U.S. PATENT DOCUMENTS

| | | | |
|---|---|---|---|
| 2,933,653 | 4/1960 | Carter | 102/70.2 R |
| 3,123,002 | 3/1964 | Spool | 102/70.2 R |
| 3,704,393 | 11/1972 | Digney, Jr. et al. | 102/70.2 R |

*Primary Examiner*—Charles T. Jordan
*Attorney, Agent, or Firm*—Dean E. Carlson; Roger S. Gaither; Clifton E. Clouse

[57] ABSTRACT

A system for safely and positively detonating high-explosive munitions, including a source of electrical signals, a split-phase square-loop transformer responsive solely to a unique series of signals from the source for charging an energy storage circuit through a voltage doubling circuit, and a spark-gap trigger for initiating discharge of the energy in the storage circuit to actuate a detonator and thereby fire the munitions.

10 Claims, 2 Drawing Figures

SAFE ARMING SYSTEM FOR TWO-EXPLOSIVE MUNITIONS

The invention disclosed herein was made under, or in, the course of Contract No. W-7405-ENG-48 with the U.S. Energy Research and Development Administration.

BACKGROUND OF THE INVENTION

The present invention relates to a munitions system in which the munitions will positively detonate only at desired times, and more particularly it relates to a system in which a high-energy electrical output is generated solely in response to a series of input signals of precise predetermined character.

Munitions systems have been developed for defeating hard-structure targets. In one such system two explosives in a single missile are provided: one explosive for detonation upon initial contact of the missile with the target for softening of the target, and a second explosive which passes to the inner area of the target and which detonates after a predetermined time delay after the initial impact of the missile. In transporting and delivering such a munitions system to a hard-structure target, it is essential to ensure positive detonation of the munitions at the desired times and to prevent their premature detonation. Electronic-electrical systems are convenient for precisely controlling the times at which the munitions are detonated and for providing the energy for detonation. Such systems, moreover, are very compact, reliable, and easily adapted for flexible control in response to a variety of input parameters. However, such systems can be susceptible to random signals such as lightning and line currents that may override the control circuits and prematurely detonate the munitions. In an electrical-electronic system, therefore, it is necessary to make provisions to ensure that the munitions cannot be prematurely detonated.

SUMMARY OF THE INVENTION

In brief, the invention is a system for safely and positively detonating high-explosive munitions; including: a signal source for supplying a series of input pulses; an output circuit; a transformer core having a square-loop hysteresis curve characteristic and saturable in first and second directions; first and second input windings wound on the core and connected to the source, and an output winding connected to the output circuit; an input circuit including the input windings and responsive solely to pulses from the source to drive the transformer core to saturation alternately in first and second directions to produce a predetermined quantity of energy in the output circuit; and means for selective control of the energy in the output circuit to detonate the munitions.

It is an object of the invention to safely and positively detonate a munitions system.

Another object is to provide a circuit that is responsive solely to a unique signal train to provide a high-power electrical output.

Another object is to prevent accidental arming and firing of an electrically controlled munitions system.

Another object is to store the energy of a series of unique input pulses to establish a charge at a predetermined voltage level and to trigger the discharge of the stored energy to a load at a precisely predetermined time.

Other objects and advantageous features of the invention will be apparent in a description of a specific embodiment thereof, given by way of example only, to enable one skilled in the art to readily practice the invention which is described hereinafter with reference to the accompanying drawing.

DESCRIPTION OF AN EMBODIMENT

Figure 1:
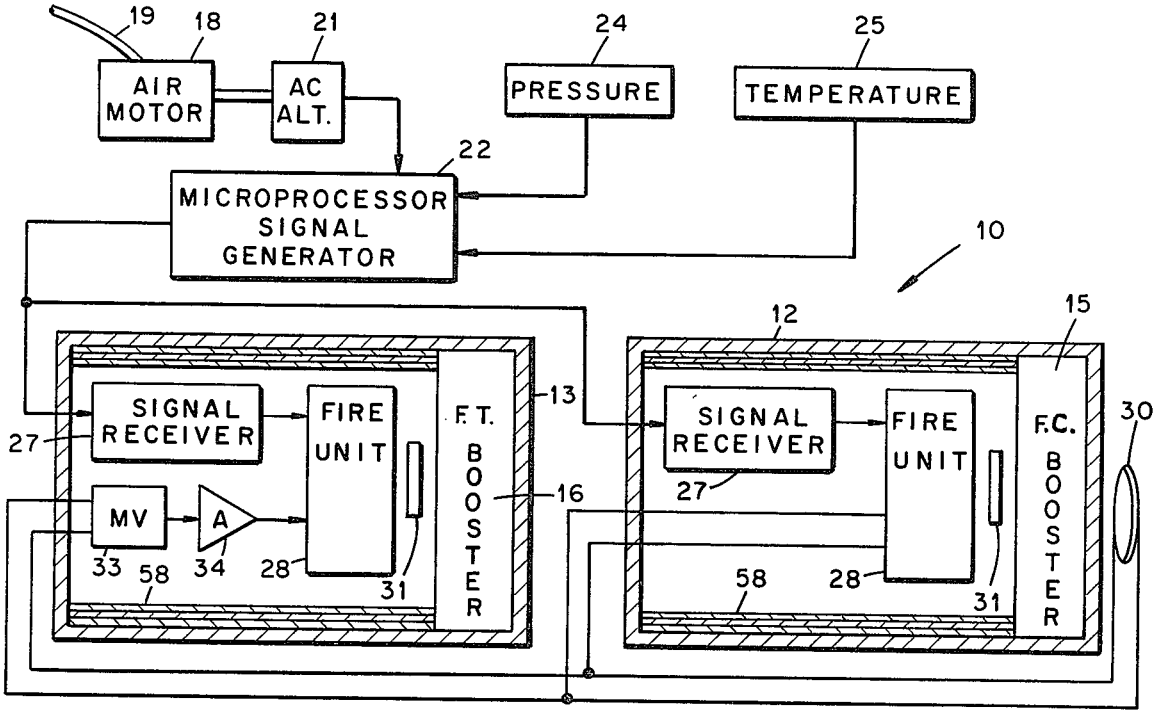
FIG. 1 is a block diagram of the electrical controls for a two-explosive munitions system for penetrating a hard-structure target, according to the invention.

Referring to the drawing there is shown in FIG. 1, a two-explosive munitions system 10 such as might be carried in an air-to-ground missile for delivery to and penetration of a hard-structure target. The system 10 includes a forward-charge module 12 and a follow-through module 13. The module 12 contains a forward-charge booster charge 15 that is detonated upon impact of the missile with the hard-structure target, while the follow-through module 13 contains a follow-through booster charge 16 that is detonated after a predetermined time interval following impact of the missile with the target. This delayed time interval is made long enough to permit the module 13 to travel into the interior of the target through the opening in the target created by the explosion of the forward charge 15.

In order to ensure that the explosives 15 and 16 are detonated at the time desired, and only at that time, positive, safe control of the individual modules 12 and 13 is provided by means of the system 10. The system 10 ensures that neither module can be armed for firing until the missile nears the target and further ensures that the module 13 will positively fire even after the module 12 and the supporting systems are destroyed by the explosion of the forward-charge booster charge 15.

In order to accomplish the objectives of safe, reliable arming and firing of the booster charges 15 and 16, the system 10 is maintained in a quiescent unarmed state without power until the missile in which it is contained is released from the aircraft carrying it. Activation of the system 10 is initiated by starting an air motor 18 by means of tension in a lanyard 19 between the air motor and the aircraft. The motor 18 is driven by air under pressure derived from the relative motion of the missile to the atmosphere. The motor 18 is used to drive an AC alternator 21 to provide power to a microprocessor unique signal generator 22. Alternatively, the motor and AC alternator may be replaced with a fluidic generator. The generator 22, however, remains inactive until signals are sent from a pressure sensor 24 and a temperature sensor 25 and/or a preselected time delay (not shown). The pressure and temperature sensors 24 and 25 respond to the range of pressures and temperatures that are expected in the flight path to the target. Thus, the generator 22 cannot arm the modules 12 and 13 for firing until just before the missile impacts the target. This minimizes the amount of time during which the modules might be fired by undesired signals.

Upon actuation of the microprocessor unique signal generator 22, a series of pulses of predetermined frequency, amplitude and polarity are generated and applied to signal receivers 27 in the modules 12 and 13. The signal receivers 27 are responsive solely to the pulses from the generator 22 to produce a predetermined output to energize associated fire control units 28 and are nonresponsive to all spurious signals as for example lightning or power line signals.

Upon energization of the first control unit 28, each of modules 12 and 13 is thereby armed to detonate their respective booster charges 15 and 16, and at this point are independent of the pulses from the generator 22 and need only a trigger to fire the charges. Such a trigger is supplied by means of a crush switch 30 which is mounted in the nose of the missile and which closes upon impact of the missile with the target. This closure triggers the fire control unit 28 in the module 12 to immediately transfer the energy in the fire unit to be utilized in a slapper detonator 31 in the module 12 which in turn fires the forward-charge booster 15 to impact against the outer portion of the target. Closure of the crush switch 30 also sets a multivibrator 33 in the module 13 from its normally stable state to an unstable state. After a predetermined time interval the multivibrator returns to its stable state to provide a signal to an amplifier 34 to generate a trigger pulse that is applied to the fire unit 28 in the module 13 to initiate transfer of the energy in the fire unit to a slapper detonator 31 in the module 13 for detonating the follow-through booster charge 16. The multivibrator 33 provides the delay necessary after closure of the crush switch 30 to fire the booster charge 16 at the desired time.

Figure 2:
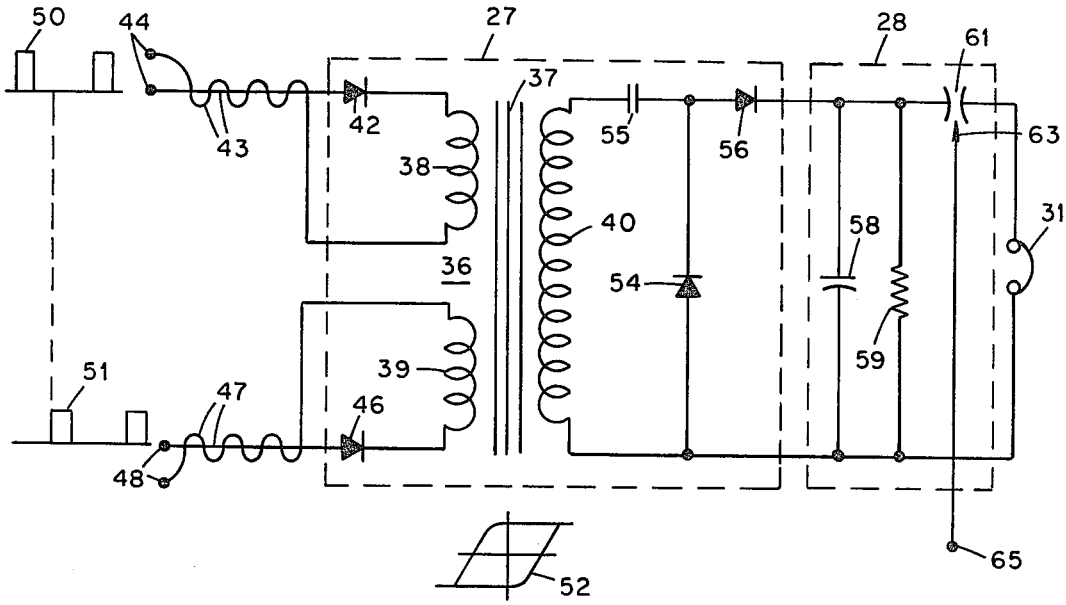
FIG. 2 is a schematic diagram of a circuit in the system of FIG. 1 for establishing an electrical charge at a predetermined voltage level independently within each of two modules in the system for independent detonation of the explosive carried in each module.

The signal receiver 27, fire unit 28, and slapper detonator 31 for the modules 12 and 13 are shown in schematic detail in FIG. 2 and are identical for each module. The receiver 27 includes a square loop transformer 36, comprised of a core 37, primary windings 38 and 39, and a secondary winding 40. The primary winding 38 is connected 43 in series with a diode 42 to a pair of twisted leads leading to a pair of input terminals 44, while the primary winding 39 is connected in a series with a diode 46 over a pair of twisted leads 47 to a pair of input terminals 48.

Upon activation of the generator 22 in response to a preset time and/or specified pressure and temperature that is ambient to the flight path to the target, the generator produces a first train of pulses 50 applied to the input terminals 44 and a second train of input pulses 51 applied to the terminals 48, the pulses 51 being 180° out of phase with the pulses 50. The pulse trains 50 and 51 drive the transformer core 37 through its characteristic hysteresis loop 52. Each successive pulse of the train 50 drives the transformer to saturation in one direction, and then the next occurrence of the corresponding pulse of the train 51 drives the transformer to saturation in the other direction. Corresponding output pulses appear across the secondary winding 40. Upon the occurrence of a positive pulse at the lower end of the winding 40, the pulse current is passed through a diode 54 to be accumulated on a capacitor 55 connected in series with the diode 54 across the winding 40. A positive charge is accumulated thereby on the right-hand plate of the capacitor 55 so that upon the core 37 being driven in the opposite direction, a positive pulse appears at the upper end of the winding 40. The voltage of this pulse is added to the voltage across the capacitor 55 for application through a diode 56 to the fire unit 28. The unit 28 includes a capacitor 58 for accumulation of the current passed through the diode 56. Thus, upon occurrence of the train of pulses 50 and 51 at the input terminals 44 and 48, a voltage is built-up across the capacitor 58 to arm the fire unit 28. A resistor 59 is connected across the capacitor 58 to bleed current and thereby require a minimum input pulse voltage level and train length to build the voltage across the capacitor 58 to a useful arming level. The slapper detonator 31 is connected in a series with a spark gap 61 across the capacitor 58. The spark gap 61 is provided with a trigger 63. A voltage applied to a terminal 65 will trigger breakdown of the gap 61 for delivery of the energy in the capacitor 58 to the slapper detonator 31 to fire the associated charge. In the module 12 such firing is initiated upon closure of the crush switch 30, while in the module 13 a triggering level is applied from the amplifier 34 after a predetermined delay provided by the multivibrator 33 after closure of the crush switch.

The particular value of the invention is the safely it provides in preventing detonation of munitions such as charges 15 and 16 before delivery to a target. The generalized concept of this safety is that a large amount of power in a unique but definitely specified form must be transferred from a power source such as the signal generator 22 to a power storage means, such as the capacitor 58 before the munitions can be detonated. The circuit 27 links the generator 22 to the capacitor 58, and the form of power that may be transferred to the capacitor 58 is defined by the characteristics of the circuit 27 and the capacitor 58. These characteristics include:

(1) a four-wire signal input is required to transfer sufficient energy to arm the fire unit 28. Destruction of either the wire pairs 43 or 47 prevents arming of the fire unit. Moreover, the wire pairs are twisted together so that any abnormal conditions such as premature destruction of the missile will destroy both wires simultaneously and thereby prevent arming and firing the missile away from the target.

(2) A two-phase signal input of a particular polarity and phase is required at each of the terminals 44 and 48 in order to transfer energy. In order to drive the core 37 through its operating region, pulses 180° out of phase and of a predetermined polarity must be applied to the terminals 44 and 48. Signals on only one of the wire pairs 43 or 47 would not drive the core 37 through a complete cycle. It is virtually impossible for erroneous signals of the correct phase and polarity to appear on both lines 43 and 47 simultaneously in the correct phase such as to transfer energy to the capacitor 58.

(3) The voltage of the pulses in the trains 50 and 51 must be of a predetermined level in order for energy to transfer to the capacitor 58. If the peak voltage of pulses applied to the terminals 44 and 48 is substantially above the predetermined level, the core 37 becomes saturated and will not allow subsequent pulses to transfer energy. If the voltage of the applied pulses is substantially below the predetermined level or the frequency of the pulses is too low, any energy transferred to the capacitor 58 is bled by the resistor 59 to thereby prevent accumulation of sufficient charge on the capacitor 58 to arm the fire unit 28.

(4) Energy transfer is also prevented should the frequency of applied pulses deviate substantially from a predetermined rate. Should the frequency be higher than the predetermined rate the core loss of the transformer 36 and the inductance of the cores 38, 39 and 40 become so large as to prevent significant transfer of energy. Should the frequency of the applied pulses become too low, current is bled from the capacitor 55 through the diode 56 and the resistor 59 at a rate that makes voltage doubling ineffective, thus preventing sufficient build up in the capacitor 58 to arm the fire unit 28.

(5) The circuits 27 and 28 are easily adapted by adjustment of the turns ratio of the windings 38, 39 and 40 to respond only to input pulses of a high-power level. Thus, the predetermined level of the pulses 50 and 51 may be set to be above commonly expected erroneous pulses.

(6) The circuits 27 and 28, and in particular the capacitor 58, may be adjusted to respond only to an extremely long series of pulses 50 and 51 to fully charge the capacitor 58 to a level that is sufficient to activate the detonator 31. This is most readily accomplished by making the capacitor 58 to have a very large capacity. Such a large capacity may be achieved by winding the layers of the capacitor into a large cylinder such that it fits just inside the periphery of the modules 12 or 13. Such a geometrical arrangement provides for a maximum surface area and therefore a maximum capacity for the capacitor 58. With such a large capacity, a very long train of pulses 50 and 51 are required to build up sufficient energy on the capacitor 58 to arm the fire unit 28. Moreover, as discussed hereinbefore the bleeding resistor 59 further requires that an extremely long series of pulses occur to charge the capacitor 58 to an arming level. The requirement for such a long train of pulses reduces the possibility that transient pulses might arm the fire unit 28, regardless of the frequency, power level, or polarity of the transient pulses. Thus, even though a series of pulses of the correct voltage, frequency, and power level might appear at the terminals 44 and 48, unless such a series is sufficiently long the fire unit 28 remains unarmed. Moreover, at the end of an erroneous series of pulses, the fire unit 28 is automatically reset, by means of the resistor 59, to its de-energized condition, ready for arming in response to valid signals applied to the receiver 27.

From the foregoing, it may be seen that there is virtually no probability of a signal, other than those in the specified form, that could result in power being transferred to the capacitor 58.

Additional safety features of the described system include the absence of any stored energy in either of the modules 12 or 13, other than the booster charges, either in mechanical or electrical form; and there is no primary explosive in either module. Such a system provides a high degree of assurance that the modules will not detonate until delivery to the target area.

Another safety feature is provided by the particular geometry of the storage capacitor 58 in that in any abnormal destructive environment, other than detonation in the target area, the capacitor 58 will be destroyed and the module thereby disarmed before other parts of the system are destroyed, such as the transformer 36. This immediate disarming provides a very high predictable degree of safety in abnormal environments.

In one embodiment of the invention that was successfully built and tested, a train of pulses 50 and 51 were generated by means of an RCA Model No. 1802 Microprocessor and applied to the input terminals 44 and 48. The pulses had a frequency of 20 kilohertz, a peak voltage of 40 volts and a 25% duty cycle; and at least $2 \times 10^5$ pulses were required for full charging of the capacitor 58 to arm the fire unit 28. The transformer core 37 was made of SQUARE ORTHONOL, a grain oriented 50% nickel-iron alloy available from Magnetics, Inc., Butler, Pa. The core was tape wound of the metal alloy into the form of a toroid having a square cross section. The primary and the secondary turns ratio were such as to give 2.5 KV across the secondary winding 40. The voltage doubling capacitor 55 was a 50 picofarad 5 KV capacitor. The diodes 42, 46, 54 and 56 were 10 KV breakdown. The capacitor 58 was wound of MYLAR to give a cylinder having a 3 inches outside diameter and a 2¼inches inside diameter; the capacitor was rated at 0.6 microfarads at 5 KV to supply a 7,000 ampere pulse through the spark gap 61, which was a SIGNALITE model TA8 to the slapper detonator 31, which is more fully described in U.S. Energy Research and Development Administration Technical Report No. UCRL-77639, *A New Kind of Detonator — The Slapper,* J. R. Stroud, Lawrence Livermore Laboratory, Livermore California, Feb. 27, 1976, which report is incorporated herein by reference to show the state of the art. The bleeder resistor 59 may be from 20 to 100 megohms.

For further discussion of the invention reference is made to U.S. Energy Research and Development Administration Technical Report No. UCID-17173, *A New Concept In-Line Fuzing Module,* Miles F. Jaroska, Lawrence Livermore Laboratory, Livermore, Calif., June 22, 1976.

While an embodiment of the invention has been shown and described, further embodiments and combinations of those described herein will be apparent to those skilled in the art without departing from the spirit of the invention.

What we claim is:

1. A system for safely and positively detonating high-explosive munitions, including:

a source for generating a series of input pulses having predetermined unique characteristics;

an output circuit;

a transformer core with a square-loop hysteresis curve characteristic and saturable in first and second directions;

first and second input windings and an output winding wound on said transformer core, said input windings being connected to said source and said output winding connected to said output circuit;

an input circuit including said input windings responsive solely to pulses having said predetermined unique characteristics for driving said transformer core to saturation alternately in first and second directions to produce a predetermined output of energy in said output circuit; and means for selective control of the energy in the output circuit to detonate the munitions.

2. The system of claim 1:

wherein said input circuit includes a first polarity discriminating means, a first pair of lines connected in series with said first polarity discriminating means to said first input winding, a second polarity discriminating means, a second pair of lines connected in series with said second polarity discriminating means to said second input winding; and wherein said pulse source generates first and second pulse trains simultaneously, said first and second pulse trains being 180° out of phase, said first pulse train being applied to said first pair of lines, said second pulse train being applied to said second pair of lines, the pulses in said first train being discriminated by said first polarity discriminating means for driving said transformer core in said first direction, and the pulses in said second train being discriminated by said second polarity discriminating means for driving said transformer core alternately in said second direction.

3. The system of claim 1, wherein said output circuit includes said output winding and means connected across said output winding for doubling the voltage appearing across said output winding.

4. The system of claim 1, wherein said control means includes a charge storage control circuit connected across said output circuit, said control circuit including a storage capacitor for storing the energy from said output circuit to a predetermined level, and means associated with said capacitor for reducing the charge on said capacitor, thereby requiring a predetermined minimum number of said input pulses to be applied to said input circuit for charge accumulation on said capacitor to said predetermined level.

5. The system of claim 4, further including:

means for utilizing the energy of the charge stored on said capacitor;

said control circuit including means for selective transfer of the charge stored on said capacitor to said utilization means.

6. The system of claim 5 utilized within a missile for carrying an explosive to a target, further including:

a crush switch carried in the nose of the missile;

and wherein said utilizing means is a slapper detonator; and said selective transfer means is a triggered spark gap responsive to closure of said crush switch upon impact of the missile to break down the gap to transfer energy from said capacitor to said slapper detonator for detonating the explosive carried by the missile.

7. The system of claim 6, further including means for delaying for a predetermined time interval after closure of said crush switch the transfer of energy from said capacitor to said slapper detonator.

8. The system of claim 4, wherein said capacitor is made of a sheet of dielectric having one side metalized, said sheet being wound into the form of a hollow cylinder, said input circuit, said output circuit, said transformer core and said windings being mounted for operation within said cylinder.

9. The system of claim 1, wherein said transformer core is made of a metal alloy tape wound in the form of a toroid having a square cross section.

10. The system of claim 9, wherein said tape is a grain oriented 50% nickel-iron alloy.

* * * * *